US005338404A

United States Patent [19]

Lucas et al.

[11] Patent Number: 5,338,404

[45] Date of Patent: Aug. 16, 1994

[54] METHOD OF FORMING A LIGNIN REINFORCED CELLULOSIC PRODUCT

[75] Inventors: Paul C. Lucas, Chester, N.Y.; Ronald J. Messenger, Matamoras, Pa.; Elizabeth Macklem-Nathan, Monroe; Lawrence C. Nykwest, Goshen, both of N.Y.

[73] Assignee: International Paper Company, Purchase, N.Y.

[21] Appl. No.: 849,475

[22] Filed: Mar. 11, 1992

[51] Int. Cl.[5] ..... D21H 11/00

[52] U.S. Cl. ..... 162/163; 162/162; 162/223; 162/225; 264/175; 264/286; 264/505

[58] Field of Search ..... 428/182, 184, 156, 532; 162/172, 180, 181.3, 163, 162, 225, 223; 427/389.9, 416, 394; 264/175, 286, 505; 106/123.1, 201

[56] References Cited

U.S. PATENT DOCUMENTS 3,849,184 11/1974 Roberts ..... 117/155 UA .

FOREIGN PATENT DOCUMENTS 884264 10/1971 Canada .

OTHER PUBLICATIONS

Tomis, B.; Kaderabek, V.; Milichovsky, M.; Vyskum. Prace Odboru Papiera Celulozy 24: V1-5 (1979); Dialog Abstract, Accession No. 266448.

Tomis, B.; Milichovsky, M.; Papir Celuloza 39, No. 2: V28-31, 41 (1984); Dialog Abstract, Acession No. 370907.

Yano, S.; Hatakeyama, T.; Hatakeyama, H.; Rept. Progr. Polymer Phys. Japan 25: 417-418 (1982); Dialog Abstract, Accession No. 370649.

Ceragioli, G.; Croce, A.; Capretti, G.; Ind. Carta 25, No. 4; 173-184 (Apr. 1987); Dialog Abstract, Accession No. 424664.

Sulan, S. and Viluda, J.; Czechosl. Pat. 192,249, Issued Sep. 25, 1981, 4 p. CL.D21C11/02. Filed: Czechosl. appln. 3,830/77 (Jul. 10, 1977).

*Primary Examiner*—Donald J. Loney

*Attorney, Agent, or Firm*—Luedeka, Neely & Graham

[57] ABSTRACT

Preformed cellulosic linerboard as utilized in the manufacture of corrugated products is provided with enhanced crush strength by a combined lignin-coating and calendering treatment. The linerboard is coated with an aqueous lignin-containing solution and then, with the coating in a wet or dry state, subjected to at least one pass through a calender nip to substantially increase the CD crush strength of the treated linerboard over the CD crush strength of an untreated linerboard or a lignin treated but uncalendered linerboard. The linerboard may be laminated with a substantially air and moisture impervious sheet to inhibit bleeding of the lignin coating in high humidity conditions.

15 Claims, 2 Drawing Sheets

METHOD OF FORMING A LIGNIN REINFORCED CELLULOSIC PRODUCT

BACKGROUND OF THE INVENTION

The present invention relates generally to the reinforcing of a preformed cellulosic board by providing it with a lignin coating followed by a strength increasing calendering operation, and more particularly to increasing the crush strength of a cellulosic linerboard by treating it with a coating of lignosulfonate and then subjecting the coated linerboard to at least one calender nip.

Improvements in the physical properties such as increases in the compressive or crush strength of linerboard as used in the fabrication of corrugated products have been previously provided by coating the linerboard with a thermosetting resin such as urea-formaldehyde. However, it is desirable to limit the release of formaldehyde vapors into the atmosphere during the manufacture of the strength-improved linerboard and the end use of such linerboard. Government regulations pertaining to the use of formaldehyde can be expected to reduce the use of urea-formaldehyde as an adhesive and as a material for improving the strength properties of cellulosic products such as linerboard.

Recent developments have shown that lignin, such as in the form of spent sulfite liquors produced as waste during sulfite pulping processes, can be utilized for providing an adhesive or binder for the manufacture of cellulosic products such as particleboard. For example, as described in "Lignin-Based Wood Adhesives" by H. H. Nimz in the publication, *Wood Adhesives, Chemistry and Technology,* edited by A. Pizzi, published by Marcel Dekker, Inc., New York, N.Y., (1983) pp 247–288, spent sulfite liquor, which contains about 50 to 60 percent lignosulfonate, can be used as an adhesive in the manufacture of particleboard by cross-linking the lignin molecules in the lignosulfonate by condensation reactions using strong mineral acids at elevated temperatures or by oxidative coupling reactions using an oxidant such as hydrogen peroxide in the presence of a catalyst such as sulfur dioxide or potassium ferricyanide. By using such a lignin cross-linking procedure, a formaldehyde-free adhesive is obtained which can be satisfactorily used in place of the urea-formaldehyde resins previously utilized in the manufacture of particleboard and the like.

Efforts have been made to utilize lignin in place of the thermosetting resins, especially urea-formaldehyde, in treating linerboard to improve the strength properties thereof. It was found that some degree of success was achieved in increasing the strength properties of linerboard by using such treatments in that the cross-machine direction (CD) crush strength of the lignin-coated linerboard was found to be about 10 percent higher than that provided by a similar linerboard without the lignin coating thereon.

A resin reinforcement for linerboard should be such that it does not interfere with the repulping of the treated linerboard or corrugated boxes made from the treated linerboard. Cross-linked polymers, such as the urea-formaldehyde, are therefor undesirable since they inhibit the redispersion of fibers during repulping. The application of a lignin coating which is not cross-linked represents an improvement over such previous practices with respect to the repulpability of the treated linerboard.

The application of a lignin coating to a cellulosic product such as linerboard is described in U. S. Pat. No. 3,849,184 and Canadian Patent No. 884,264. Generally, the treatments of linerboard as described in these patents require the use of other natural or synthetic resins along with the lignosulfonate in order to achieve the strength improvements provided by the treatment or to enhance the water resistance of the treated paper product.

SUMMARY OF THE INVENTION

Accordingly, it is an object of the present invention to provide a treatment of cellulosic linerboard wherein the CD crush strength of the linerboard is even further increased over the crush strength of untreated linerboard or linerboard coated with lignin as briefly described above.

Another object of the present invention is to provide a linerboard with a coating of lignin and then calendering the lignin-coated linerboard through at least one calender nip for substantially increasing the crush strength of the linerboard.

Another object of the present invention is to provide linerboard with increased compressive strength for use with a corrugated medium to produce corrugated products having increased strength properties.

Another object is to provide a corrugated product formed of a corrugated medium and a linerboard treated with an uncured lignin coating and calendered in accordance with the present invention and with the linerboard bonded at a coated side or an uncoated side thereof to a corrugated medium to provide the corrugated product with increased compressive strength, stiffness, and durability.

Another object of the present invention is to laminate a lignin-calender treated linerboard with a light-weight material substantially impervious to air and/or moisture after the calendering step so as to inhibit reductions in strength increases instilled in the linerboard as provided by the lignin-calendering treatment due to exposure of the linerboard to moisture or an atmosphere of high relative humidity.

A still other object of the present invention is to provide for increasing the strength properties of linerboard by treating the linerboard with a coating of lignin and then calendering the coated linerboard with the coating in a wet or dry state to provide the coated linerboard with a substantial increase in crush strength over that provided by an untreated linerboard.

Generally, the method for treating a linerboard formed of cellulosic fibers in order to increase the crush strength of the linerboard comprises the steps of: coating at least one surface of the linerboard with a liquid dispersion containing lignin; and calendering the coated linerboard by subjecting the linerboard to at least one pass through a calender nip at a temperature and pressure adequate to increase the strength of the linerboard over that of an untreated linerboard. The calendering temperature is in the range of about 70° to 400° F., the calendering pressure is in the range of about 50 to 1,000 pli, and the linerboard is passed through the calender nip at a rate of about 50 to 2,000 feet per minute. Also, the coated linerboard may be subjected to a plurality of successive passes through the calender nip for providing the coated linerboard with an increase in strength with each pass through the calender nip.

The lignin utilized in the liquid dispersion is preferably a lignosulfonate, and more preferably a lignosulfonate from spent sulfite liquor. Hydrogen peroxide (30–35% solution) may be employed in the liquid dispersion in a concentration of about 0 to about 1.0 mole per 100 grams of lignosulfonate solids.

Other and further objects of the present invention will become obvious upon an understanding of the illustrative method and embodiments about to be described or will be indicated in the appended claims, and various advantages not referred to herein will occur to one skilled in the art upon employment of the invention in practice.

Figure 1:
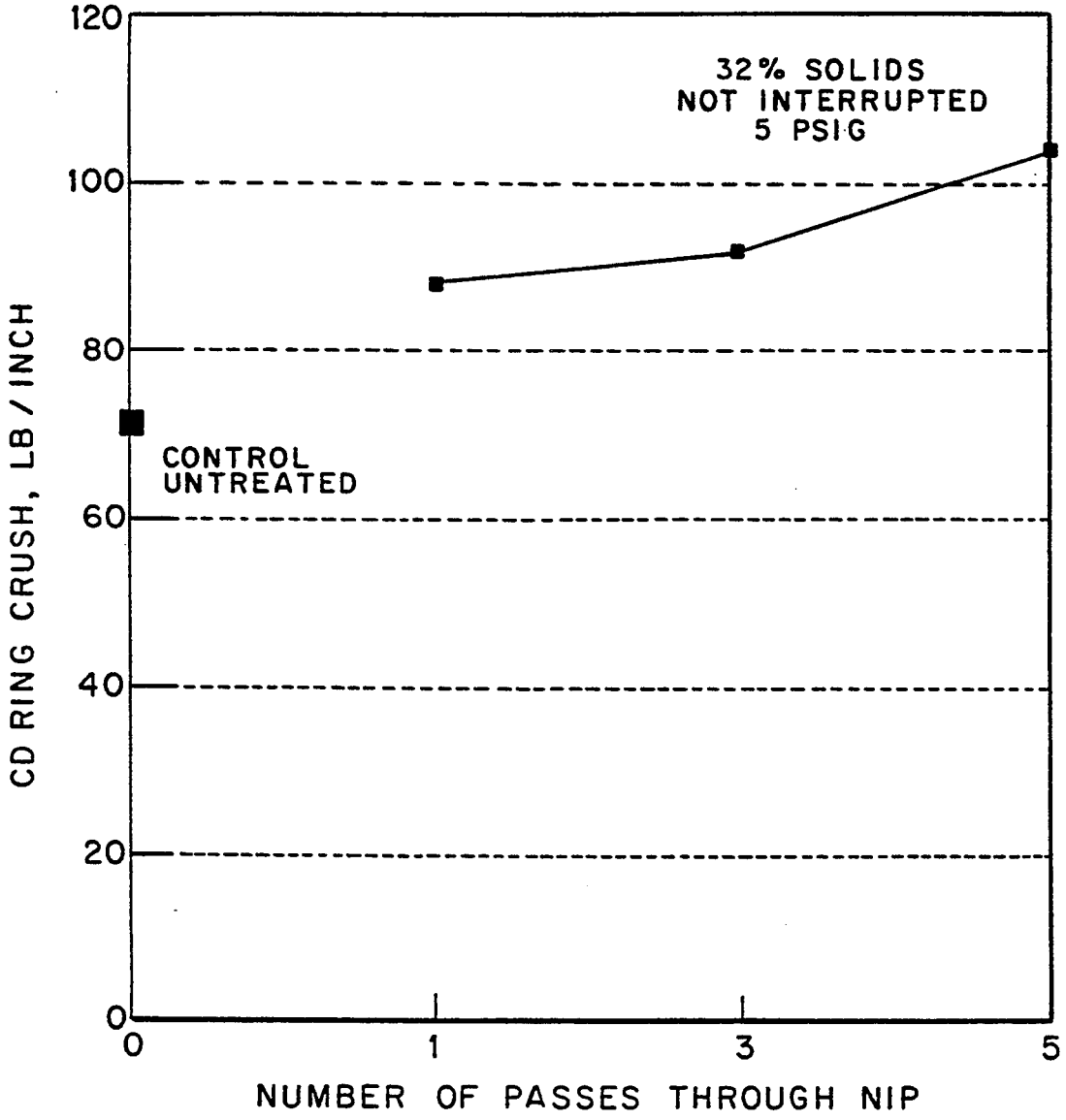
FIG. 1 is a graph illustrating the enhanced CD ring crush strength in pounds per square inch obtained at 73° F. and 50% relative humidity with a 42 lb/MSF liner base sheet treated in accordance with the present invention at each of several calender nips as well as showing a comparison of the CD crush strength provided by the treated liner base sheet with that of a similar but untreated liner base sheet.

The graphs have been chosen for the purpose of illustration and description and are not intended to be exhaustive nor to limit the invention to the precise lignin formulation and strength increases shown. These graphs are chosen and described in order to best explain the principles of the invention and their application and practical use to thereby enable others skilled in the art to best utilize the invention in various embodiments and modifications as are best adapted to the particular use contemplated.

DETAILED DESCRIPTION OF THE INVENTION

As briefly described above, the present invention is directed to improving the compressive strength of linerboard formed from an aqueous slurry of cellulosic fibers. The linerboard is treated by providing it with a coating of lignin and then calendering the coated linerboard to provide the linerboard with a CD crush strength significantly greater than that afforded by an untreated linerboard or a linerboard merely treated with a coating of lignin.

In accordance with the present invention, preformed cellulosic linerboard of a weight in the range of about 20 to 90 lbs/MSF is coated on one or both sides thereof with an aqueous solution containing lignin. The aqueous solution is applied to the linerboard by a brush, spraying, or any other suitable mechanism at a spread rate of about 0.5 to 10 lbs/MSF dry solids, preferably about 3 lbs/MSF. The lignin forms an adherent coating on the linerboard which, when dried, improves the CD crush strength of the linerboard about 10% over that provided by an untreated linerboard of the same type and weight.

The calendering operation for increasing the strength properties of the linerboard as signified by the CD STFI and ring crush strength may be accomplished by employing any suitable, commercially available, calendering apparatus capable of providing the desired number of passes (one or more) through a calender nip at a desired temperature, pressure, and linerboard feed rate. These operational parameters for the calendering apparatus as utilized for substantially increasing the crush strength of the linerboard are somewhat dependent upon the weight of the linerboard, the wet or dry state of the lignin coating, and the thickness of the lignin coating. Satisfactory results can be achieved by employing a calender nip temperature in the range of about 70° to 400° F., preferably about 300° to 350° F., a calender nip pressure in the range of about 50 to 1,000 pli, preferably about 100 pli to 278 pli, and a linerboard feed rate through the calender nip of about 50 to 2,000 ft/min, preferably about 150 ft/min for a three-sixteenth inch nip width. A greater nip width would allow for higher linerboard feed rates.

The aqueous solution used for producing or providing the coating of lignin on one or both surfaces of the linerboard may be provided by using a lignin, preferably in the form of a lignosulfonate such as ammonia lignosulfonate, sodium lignosulfonate, calcium lignosulfonate, magnesium lignosulfonate or any other commercially available lignosulfonate. Other lignin forms including modified lignins such as desulfonated lignin may be satisfactorily used in the practice of the present invention. Preferably, the lignosulfonate is provided by spent sulfite liquor. The concentration of the lignin in the coating formulation is in the range of about 5 to about 65 weight percent, preferably in the range of about 30 to 40 weight percent.

It is desirable to incorporate a wetting agent in the aqueous formulations to assure that the surface of the linerboard is adequately and uniformly wetted with the formulation in a manner better and more rapidly than that provided by the aqueous formulations. The wetting agent, if used, may comprise about 10 weight percent of the lignin in the formulation and includes such agents as sulphonic acids and their derivatives, sulfates of higher aliphatic alcohols, pine oil, and the like. Such wetting agents are commonly utilized in the coating industry as aids for effecting a thorough wetting of cellulosic product.

In preparing the formulation, it is necessary to use a formulation with sufficient liquidity so that it may be spread uniformly over the surface of the linerboard. The liquid portion of the formulation is preferably provided by water in a concentration ranging from a quantity adequate to effect the uniform dispersal of the formulation constituents throughout the surface up to a quantity corresponding to about 95% of the formulation when the lignin is at the minimum concentration as set forth above. For example, a typical formulation which can be utilized as the linerboard treatment in accordance with the present invention may be provided by 100 grams of ammonia lignosulfonate (50% solids), 33 grams of hydrogen peroxide (30% solution), 5 grams of a wetting agent (10% solution), and 18 grams of water. This formulation is of sufficient liquidity to be uniformly dispersed or spread over the surface and provides a coating of lignin thereon in a sufficient concentration to accomplish the strength increasing properties desired of the linerboard when subsequently calendered.

The coating formulation is preferably applied to the linerboard to a surface of the linerboard as an off-machine operation at the dry end of the linerboard manufacturing machine. However, it will appear clear that the coating may be applied at the wet end of the linerboard manufacturing machine, i.e., prior to the dryer since the strength increasing calendering of the lignin-coated linerboard can be successfully provided with the lignin-coating while the coating on the linerboard is still wet or after it has dried.

As mentioned above, the lignin coating may be applied to one or both sides or surfaces of the linerboard. When the coating is applied to a single surface of the linerboard and the latter is used in the fabrication of a corrugated product, the lignin treated surface may be positioned inwardly so as to be in contact with and bonded to the corrugated medium or liner. The lignin treatment provides a surface on the linerboard which is gluable to the corrugating medium, thus leaving the untreated surface of the linerboard exposed as a "natural" surface for facilitating the reception of suitable printing or other indicia. Of course, the lignin treated surface may be positioned outwardly from the corrugated medium so that the bonding of the corrugated medium is with the untreated surface of the linerboard.

One of the concerns in using uncured lignin-treated linerboard is due to bleeding of the coating when the lignin coating gets wets, even after the strength increasing calendering operation is completed. The wetting of the coated linerboard and the consequential bleeding of lignin coating detracts from the strength-increasing properties instilled in the board. A highly satisfactory solution to this concern is provided by laminating a substantially air and water or moisture impervious material over the lignin treated surface of the linerboard. This material is preferably a light-weight material such as provided by 2 to 10 lb/MSF polyethylene, polypropylene, polyethylene terephthalate or thermoplastic-coated paper. The laminating of the light-weight material or cover sheet onto the lignin-coated surface of the linerboard is achieved either by using a typical laminating adhesive such as emulsion glue or by covering the lignin-treated surface while in a dry and calendered condition with the light weight material and passing it through the hot calender nip to thermally bond the light-weight cover sheet to the linerboard.

Forty-two lb/MSF Kraft liners were coated with approximately 3 lb/MSF of ammonia lignosulfonate (30 and 32% solids). Cover sheets of 60 lb/3,000 $ft^2$ polyethylene-coated paper were laminated onto the linerboards by hot calendering. The approximate basis weight of the laminated linerboards was 62 lb/1000 $ft^2$. A control sample was provided of the 42 lb/MSF by laminating a similar weight polyethylene-coated paper to an untreated linerboard by hot calendering. The laminating operation was completed by passing each of the polyethylene-coated paper and lignin-coated linerboards through a calender at a nip pressure of 350 pli, a temperature of 320° F., and at a feed rate of 150 ft/min. Calendered samples of the polyethylene -lignin-coated linerboard were tested for porosity and for CD crush strength by using the CD STFI. The CD crush strength using the STFI procedure provided by the laminated control linerboard after calendering was 37.9 lbs/in while the laminated, lignin-coated linerboards after calendering revealed CD crush strengths that varied from 47.8 lbs/in to 52 lbs/in. These results were derived by running ten samples for each condition and indicated that a 26 to 38 percent increase in the STFI strength was provided by the laminated lignin-coated linerboard over the laminated control sample. In a porosity test of the laminated structure, it was found that air would pass through the laminated control board at a rate which could be measured in minutes, while the passage of air through the laminated lignin-coated linerboard after calendering was so slow that accurate measurements of the leak rate required a period of days rather than minutes. Thus, the lignin-coated, laminated sheets provided a significant barrier to moisture and atmospheres under high humidity conditions.

If desired, the lignin-coated linerboard can be calendered before applying the cover sheet onto the coated surface of the linerboard. The cover sheet can be bonded to the cured lignin coating by a suitable adhesive such as polyvinyl acetate or by thermal bonding to form the laminated structure.

When using the laminated structure in the manufacture of a corrugated product which may be exposed to high humidity conditions or subjected to possible wetting, the untreated or natural surface of the linerboard is preferably bonded to the corrugated medium. However, if desired, the treated surface, i.e., the side containing the polyethylene-coated paper or other cover sheet may be bonded to the corrugated medium by using a suitable adhesive such as starch or other conventional corrugating adhesives.

In order to provide a more facile understanding of the present invention, the following examples illustrative of the invention are provided.

EXAMPLE 1

With reference to FIG. 1, the CD crush strength in pounds per inch of a 42 lbs/MSF liner base sheet (linerboard) prepared from cellulosic fibers derived from a Kraft pulp was compared with CD ring crush strength of a similar weight liner base sheet but untreated with the lignin-calender treatment of the present invention. The lignosulfonate coating formulation employed for surface treating the linerboard was a formulation containing 100 grams of ammonia lignosulfonate (50% solids), hydrogen peroxide (30%) providing about 33 grams per hundred grams of the lignosulfonate, 5 grams of a wetting agent (10% solution), and 12 grams of water. The formulation was applied by a rod coater onto the linerboard at a spread rate of 3 lb/MSF dry solids. The calendering conditions utilized for the strength increase of the lignosulfonate coated linerboard were provided by passing the linerboard (wet coating) through the calender nip at a feed rate of 150 ft/min at a 315° F. calender nip temperature, and a 100 pli (5 psig) pressure on the calender rolls at each nip. As illustrated in FIG. 1, the CD ring crush strength for untreated control linerboard at 73° F. and 50% RH was approximately 72 lbs/in, whereas the linerboard crush strength increased significantly up to approximately 88 lbs/in with one pass through the calender nip and up to approximately 104 lbs/in with 5 passes through the calender nip. The graph of FIG. 1 clearly illustrates that an increase of about 22 to 44% in the CD ring crush strength is achieved with the linerboard treated in accordance with the present invention over the CD ring crush strength provided by an untreated control linerboard of the same weight.

EXAMPLE 2

Figure 2:
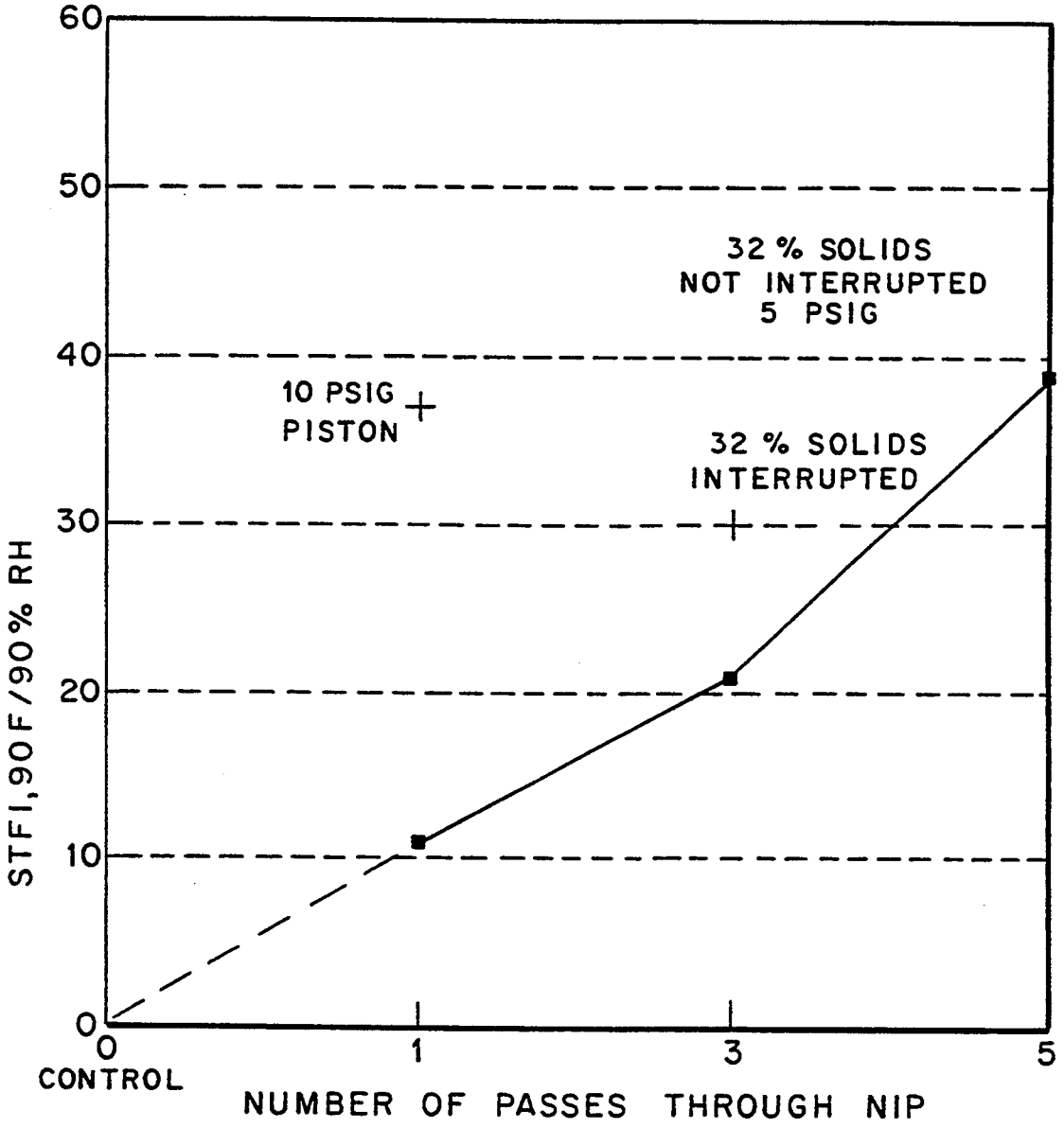
FIG. 2 is a graph illustrating the percent increases in CD crush strength by STFI measurements of a cellulosic linerboard treated in accordance with the present invention over the crush strength of an untreated control linerboard at 90° F. and 90% relative humidity with the linerboard being provided by a 42 lb/MSF liner base sheet and with the percent increase shown at different calender pressures and at each of several calender nips.

With reference to FIG. 2, several linerboards coated with a lignosulfonate formulation similar to that provided in the Example were subjected to calendering at a calender nip pressure using a 100 pli (5 psig) while other similarly coated linerboards were subjected to calendering at a calender nip pressure provided by a 278 pli to demonstrate the increases in CD crush strength of the treated linerboard by using STFI testing procedures of the treated linerboard. As shown in FIG. 2, a comparison of linerboards treated in accordance with the present invention with a control linerboard clearly indicates that the crush strength of the treated linerboard is substantially greater than that of the control linerboard with a single pass through the calender nip. This increase in crush strength is, as shown, even greater with each additional pass through the calender nip. Also, by increasing the calender nip pressure from 5 psig to 10 psig, the crush strength instilled in the lignin-coated linerboard by one pass through the calender nip increased from about 11% STFI to about 37% STFI over the STFI crush strength provided by the control sample. The crush strength of the coated linerboard, with 5 passes through the calender nip (100 pli −5 psig), was increased to 38% greater than the crush strength of the untreated control sample.

EXAMPLE 3

A 42 lb/MSF linerboard treated with a coating of ammonia lignosulfonate (32% solids) using a coating formulation as in Example 1, indicated that the linerboard, before calendering, possessed an increase in CD ring crush strength from 98 lb/in for an uncoated control linerboard to 107 lb/in. This CD ring crush strength increase afforded by the cured lignosulfonate coating was approximately 10%. However, when a similar lignin-coated linerboard was calendered (dried coating) by a three passes through a calender nip at 315° F. and 100 pli pressure at a feed rate of 150 ft/min, the crush strength of the calendered lignin-coated linerboard was increased to 120 lb/in (a 22% increase). When a lignin-coated linerboard was similarly calendered before the lignosulfonate coating had dried, the CD ring crush strength was increased to 127 lb/in (a 30% increase). In a further demonstration of the combined effects of the lignin coating and the calendering operation of the present invention, it was found that the calendering of a water-wetted linerboard that was not provided with the lignin coating provided the linerboard with a CD crush strength of 97 lb/in. This level of crush strength does not represent any increase in crush strength over that of the control sample so as to clearly indicate that a press/drying effect is not achieved when calendering linerboard that is wetted with an aqueous lignin coating in accordance with the present invention.

EXAMPLE 4

In a still further demonstration of the enhanced compressive strength provided in linerboard by the practice of the present invention, an untreated linerboard having a CD ring crush strength of 98 lb/in was compared to several linerboards, each treated with a coating of sodium lignosulfonate containing 32% solids of a coating formulation as used in Example 1 but without the hydrogen peroxide in the coating formulation. The coating when dried provided the lignin-coated linerboard with a CD ring crush strength increase from the 98 lb/in to about 113 lb/in (a 15% increase). When a similarly coated linerboard (dried coating) was calendered as in Example 3, the CD ring crush strength was increased to 118 lb/in (a 20% increase). Further, the calendering of a wet lignin-coated linerboard provided a CD ring crush strength of 131 lb/in (a 37% increase).

The substantial enhancement of the crush strength of calendered linerboard obtained by using the ammonia lignosulfonate coating in Example 3 or the sodium lignosulfonate coating of Example 4 clearly demonstrates that the crush strength increasing properties instilled in the linerboard by using the combination of the lignosulfonate coating and the calendering operation can be achieved by using a variety of lignosulfonates.

In an alternative embodiment, it is believed that a satisfactory treatment to the linerboard can be provided by cross-linking the lignin molecules in the lignin coating prior to the calendering operation. Such cross-linking of the lignin may be achieved by oxidative coupling reactions in the presence of a suitable catalyst.

The oxidant used for cross-linking the lignin molecules includes hydrogen peroxide in a concentration effective to cross-link essentially all of the lignin molecules in the coating solution or formulation. The hydrogen peroxide (30–35%) is in an effective concentration of about 0 to about 1.0 mole per 100 grams of lignin. This concentration of hydrogen peroxide is sufficient to effect the desired cross-linking.

The oxidant may be premixed with the lignin immediately prior to the application of the formulation onto the linerboard or, alternatively, the oxidant may be dispensed separately onto the linerboard to assure that any cross-linking occurring prior to the application of the formulation onto the linerboard is insufficient to detract from the bonding of the cross-linked lignins onto the surface of the linerboard. As pointed above, a catalyst is used to accelerate the oxidative coupling reactions. A catalyst or activator suitable for such acceleration or promotion of the oxidative coupling reaction are those as mentioned in the aforementioned publication and also include hydrogen peroxide decomposers/activators such as ferrous salts, iodide salts, ammonia chloride, ammonia acid salts, bisulfite salts, and the like. These reaction promoters may be utilized in the formulation and in a concentration corresponding to about 0.1 to 10 weight percent of the formulation and may be incorporated in the formulation as it is being applied to the linerboard.

It will be seen that the present invention provides a significant improvement in the strength properties, especially CD crush strength, of linerboard by employing lignin from pulping waste so as to obviate the use of environmental polluting substances such as urea-formaldehyde. The utilization of the lignin-calender treated linerboard in the fabrication of corrugated products provides the finished product with a substantial increase in stiffness, crush strength, and durability over that obtainable using untreated linerboard. The treated linerboard of the present invention is expected to be useful in the manufacture of corrugated products wherein the linerboard is glued to one or both sides of the corrugated liner or medium with a suitable adhesive such as a starch adhesive or the like. By using linerboard with enhanced strength properties as provided by the present invention, the corrugated products are expected to exhibit enhanced crush strength, stiffness, and durability.

What is claimed is:

1. A method for increasing the crush strength of a linerboard formed of cellulosic fibers, comprising treating the linerboard by coating at least one surface of the linerboard with a liquid dispersion containing lignin, and calendering the coated linerboard by subjecting the coated linerboard to at least one pass through a calender nip at a pressure of about 100 pli to about 1,000 pli and a temperature of about 300° F. to about 400° F. to substantially increase the crush strength of the coated-calendered linerboard over that of an untreated linerboard.

2. A method as claimed in claim 1, wherein the linerboard is passed through the calender nip at a rate of about 50 to 2,000 feet per minute.

3. A method as claimed in claim 1, wherein the calendering step is provided by subjecting the coated linerboard to a plurality of successive passes through at least one calender nip for providing the coated linerboard with an increase in crush strength with each pass through the calender nip.

4. A method as claimed in claim 1, including the additional steps of contacting a surface of the linerboard subsequent to said calendering step with a cellulosic corrugated medium, and adhesively securing the corrugated medium to the surface of the linerboard contacted thereby for forming a corrugated product.

5. A method as claimed in claim 1, including the additional step of contacting the lignin in the liquid dispersion with an oxidant in the presence of a catalyst for cross-linking lignin molecules through oxidative coupling reactions.

6. A method as claimed in claim 1, including the additional step of contacting one of said at least one coated surface of the linerboard after said calendering thereof with a sheet of material substantially impervious to air and moisture, and wherein the calendering of said linerboard with said sheet of material thereon forms a laminated structure with said sheet of material being bonded to said linerboard by an adhesive or thermal bonding.

7. A method as claimed in claim 6, wherein said sheet of material is a polymer selected from the group consisting of polyethylene, polypropylene, and polyethylene-terephthalate.

8. A method as claimed in claim 1, wherein the lignin is provided by a lignosulfonate.

9. A method as claimed in claim 8, wherein the lignosulfonate is provided by spent sulfite liquor.

10. A method as claimed in claim 8 wherein the liquid dispersion contains about 5 to about 65 weight percent lignosulfonate solids.

11. A method as claimed in claim 10, wherein the dispersion is an aqueous dispersion containing a concentration of water adequate to provide for coating the linerboard with the dispersion at a spread rate of about 0.5 to 10 pounds of solids per thousand square feet of linerboard.

12. A method as claimed in claim 11, wherein the wherein the hydrogen peroxide is contained in said aqueous dispersion in a concentration of about 0 to about 1 mole per 100 grams of lignosulfonate solids.

13. A method as claimed in claim 10, including the addition step incorporating in the dispersion a wetting agent in a concentration of about 10 weight percent of the lignosulfonate solids.

14. A method as claimed in claim 3, wherein said at least one pass of the coated linerboard through the calender nip is provided while the coating on the linerboard is in a wet state.

15. A method as claimed in claim 3, wherein said at least one pass of the coated linerboard through the calender nip is provided after the coating on the linerboard is in at least a substantially dry state.

* * * * *

UNITED STATES PATENT AND TRADEMARK OFFICE

CERTIFICATE OF CORRECTION

PATENT NO. : 5,338,404

DATED : Aug. 16, 1994

INVENTOR(S) : Paul C. Lucas

It is certified that error appears in the above-indentified patent and that said Letters Patent is hereby corrected as shown below:

The title page drawing along the ordinate following "CD RING CRUSH," delete "/INCH."

Figure 1, along the ordinate following "CD RING CRUSH," delete "/INCH."

Column 3, line 14, delete "per square inch."

Column 6, line 30, delete "per inch".

Column 6, delete "/in" in lines 51, 53 and 54.

Column 7, delete "/in" in lines 26, 27, 35, 38, 44, 56, 63 (two occurrences), 66, and 68.

Signed and Sealed this

Twenty-eight Day of February, 1995

*Attest:*

Bruce Lehman

BRUCE LEHMAN

*Attesting Officer*

*Commissioner of Patents and Trademarks*